US011440031B2

(12) United States Patent
Badita

(10) Patent No.: US 11,440,031 B2
(45) Date of Patent: Sep. 13, 2022

(54) JET FOR SWIM-IN-PLACE SPA

(71) Applicant: HYDROPOOL INC., Mississauga (CA)

(72) Inventor: Nicolae Badita, Brampton (CA)

(73) Assignee: HYDROPOOL INC.

( * ) Notice: Subject to any disclaimer, the term of this patent is extended or adjusted under 35 U.S.C. 154(b) by 0 days.

(21) Appl. No.: 16/815,069

(22) Filed: Mar. 11, 2020

(65) Prior Publication Data

US 2020/0206759 A1 Jul. 2, 2020

Related U.S. Application Data

(63) Continuation of application No. 15/910,095, filed on Mar. 2, 2018, now Pat. No. 10,688,505.

(60) Provisional application No. 62/466,628, filed on Mar. 3, 2017.

(51) Int. Cl.

| | |
|---|---|
| ***B05B 1/26*** | (2006.01) |
| ***A63B 69/12*** | (2006.01) |
| ***E04H 4/12*** | (2006.01) |

(52) U.S. Cl.

CPC ..... *B05B 1/26* (2013.01); *A63B 69/125* (2013.01); *E04H 4/12* (2013.01)

(58) Field of Classification Search

CPC ..... E04H 4/0006; E04H 4/12; E04H 4/1245; A63B 69/125; A61H 33/026; A61H 33/027; B05B 1/262

See application file for complete search history.

(56) References Cited

U.S. PATENT DOCUMENTS

| | | | | |
|---|---|---|---|---|
| 3,625,820 | A * | 12/1971 | Gluntz | G21C 15/25 376/372 |
| 4,001,899 | A | 1/1977 | Mathis | |
| 4,507,969 | A * | 4/1985 | Djordjevic | G01N 29/28 73/644 |
| 4,941,217 | A | 7/1990 | Tobias et al. | |
| 5,207,729 | A | 5/1993 | Hatanaka | |
| 6,685,102 | B1 | 2/2004 | Mi et al. | |
| 6,877,960 | B1 | 4/2005 | Presz, Jr. et al. | |
| 7,526,820 | B2 | 5/2009 | Murdock et al. | |
| 7,984,519 | B1 * | 7/2011 | Hall | E04H 4/005 4/507 |

(Continued)

FOREIGN PATENT DOCUMENTS

| | | | | |
|---|---|---|---|---|
| AU | 2009202334 | A1 * | 1/2010 | A63B 69/125 |
| DE | 202011106999 | U1 * | 12/2011 | E04H 4/0006 |
| EP | 1892458 | A1 | 2/2008 | |

*Primary Examiner* — Erin Deery

(74) *Attorney, Agent, or Firm* — Lorelei G. Graham

(57) ABSTRACT

There is provided a swim-in-place spa, comprising a basin for containing water, a circulation subsystem having a primary conduit extending from an inlet in the basin, a pump fluidly connected to the primary conduit to pump water from the inlet, a swim-in-place jet affixed to the basin, and a secondary conduit extending from the pump to the swim-in-place jet, in operation the pump inducing a flow of water toward the swim-in-place jet. The swim-in-place jet has a nozzle and a diffuser downstream of the nozzle relative to the flow of water, a nozzle outlet smaller than a diffuser inlet, the nozzle outlet and the diffuser inlet disposed in a spaced-apart relationship defining a gap for receiving a flow of entrained water. The circulation subsystem is configured for creating a water jet matching a cross-section of a swimmer.

20 Claims, 11 Drawing Sheets

(56) References Cited

U.S. PATENT DOCUMENTS

| | | | |
|---|---|---|---|
| 9,855,479 | B2 | 1/2018 | Cameron et al. |
| 2009/0064404 | A1 | 3/2009 | Frei |
| 2010/0327077 | A1 | 12/2010 | Parsheh et al. |
| 2011/0004993 | A1 | 1/2011 | Frei |

* cited by examiner

JET FOR SWIM-IN-PLACE SPA

TECHNICAL FIELD

The application relates generally to swim-in-place spa and, more particularly, to devices used to generate current stream in a swim-in-place spa.

BACKGROUND OF THE ART

A swim-in-place spa, also referred to as a swim-in-place pool, is sometimes used in areas where there is insufficient space to install a swimming pool or simply used to provide uninterrupted swimming to a user in a limited body of water. Such spa comprises a current creating device. The device uses a swim-in-place jet to produce a jet directed toward a swimmer. The jet is configured such that the forces on the swimmer balance. The swimmer thereby swims but stays substantially immobile relative to the spa.

In most cases, the device requires a plurality of swim-in-place jets to generate a sufficient mass flow rate to balance a thrust generated by a swimmer. The plurality of jets thus creates a non-uniform velocity profile in the swim-in-place spa. Hence, different portions of a swimmer's body experiment different forces and the water surface is turbulent. The waves on the water surface impair the swim quality compared to a traditional swimming pool.

SUMMARY

In one aspect, there is provided a swim-in-place jet that comprises a nozzle configured to accelerate a primary flow of water. The primary flow is directed inside a diffuser and creates a Venturi effect causing entrainment of a secondary flow inside the diffuser. The total exit mass flow rate of the swim-in-place jet is thereby higher than the mass flow rate of the primary flow. In one aspect, there is provided a swim-in-place jet that increases the mass flow rate while reducing the speed of the ejected water. The flow momentum is therefore similar, but turbulence in the swim-in-place spa is reduced. Thereby, a swim quality similar to a regular swimming pool is offered to the swimmer.

In another aspect, there is provided a swim-in-place spa, comprising: a basin for containing water, a circulation subsystem having: a primary conduit extending from an inlet in the basin; a pump fluidly connected to the primary conduit to pump water from the inlet; a swim-in-place jet affixed to the basin; and a secondary conduit extending from the pump to the swim-in-place jet, in operation the pump inducing a flow of water toward the swim-in-place jet, the swim-in-place jet having a nozzle and a diffuser downstream of the nozzle relative to the flow of water, a nozzle outlet smaller than a diffuser inlet, the nozzle outlet and the diffuser inlet disposed in a spaced-apart relationship defining a gap for receiving a flow of entrained water, the circulation subsystem configured for creating a water jet matching a cross-section of a swimmer.

In a particular embodiment, the ratio is greater than 2. The swim-in-place spa may comprise two swim-in-place jets affixed to the basin and spaced-apart relative to a width of the swim-in-place spa. The swim-in-place spa may comprising two pumps, each of the two pumps fluidly connected to a respective one of the two swim-in-place jets.

In yet another aspect, there is provided a swim-in-place jet, comprising: a nozzle having a nozzle inlet for receiving a primary flow from a pressurized water source and a nozzle outlet; a diffuser downstream of the nozzle relative to the primary flow, the diffuser and the nozzle disposed in a spaced-apart relationship to define a gap for receiving a secondary flow entrained by the primary flow in the diffuser, the nozzle outlet smaller than a diffuser inlet, the diffuser having a diffusing section in which a cross-section increases, the diffuser inlet smaller than a diffuser outlet; a ratio of a width over a height of the diffuser outlet being greater than 2.

In a particular embodiment, a ratio of a nozzle inlet area over a nozzle outlet area is 9.5, a ratio of a width over a height of the nozzle inlet is greater than 2, a ratio of a width over a height of the nozzle outlet is equal to or greater than 16, and a ratio of a width over a height of the diffuser inlet is from 4 to 10.

In a particular embodiment, the diffuser further has a mixing section upstream of the diffusing section, a ratio of a distance along the primary flow between the nozzle outlet and an inlet of the mixing section over a height of the mixing section is from 0.45 to 1.15.

In still another aspect, there is provided a diffuser for a swim-in-place jet, comprising an inlet and an outlet downstream of the inlet relative to a flow circulating therein, the diffuser having a converging section downstream of the inlet, a diverging section upstream of the outlet, and a mixing section between the converging and diverging sections, a cross-sectional area of the diffuser decreasing in the converging section and increasing in the diverging section, the outlet being greater than the inlet, a transition between the mixing and diverging sections being continuously gradual.

In a particular embodiment, a ratio of a width over a height of the outlet is greater than 3, a ratio of a length of the diffuser over a height of the inlet is from 13 to 15. In a particular embodiment, the converging section has an opening angle of 25 degrees and the diverging section has an opening angle of from 8 to 25 degrees.

In a particular embodiment, an intersection between the mixing section and the diverging section has a parabolic shape. In a particular embodiment, a length of the mixing section corresponds to at least 60% of a total length of the diffuser, the mixing section having a constant cross-section.

In another aspect, there is provided a swim-in-place jet assembly, comprising: an enclosure having a wall extending around a longitudinal axis, an inlet, an outlet axially spaced-apart from the inlet relative to the longitudinal axis, and apertures defined through the wall; a nozzle within the enclosure and having a nozzle inlet proximate the inlet of the enclosure; and a diffuser within the enclosure and having a diffuser inlet axially offset relative to the nozzle inlet and a diffuser outlet proximate the outlet of the enclosure.

In a particular embodiment, the swim-in-place jet assembly further comprises a plurality of fins extending between the nozzle and the wall and between the diffuser and the wall for positioning the nozzle and the diffuser relative to the enclosure.

In a particular embodiment, the swim-in-place jet assembly further comprises an input chamber fluidly connected to and upstream of the enclosure. The input chamber has a wall extending around the longitudinal axis and a flange extending radially-outward from the wall of the input chamber, the flange abutting against an annular surface defined by a thickness of the wall of the enclosure.

In a particular embodiment, the swim-in-place jet assembly further comprises a flow straightener disposed within the enclosure, between the diffuser outlet and the enclosure outlet, and perpendicular to the longitudinal axis.

DESCRIPTION OF THE DRAWINGS

Reference is now made to the accompanying figures in which.

DETAILED DESCRIPTION

Figure 1:
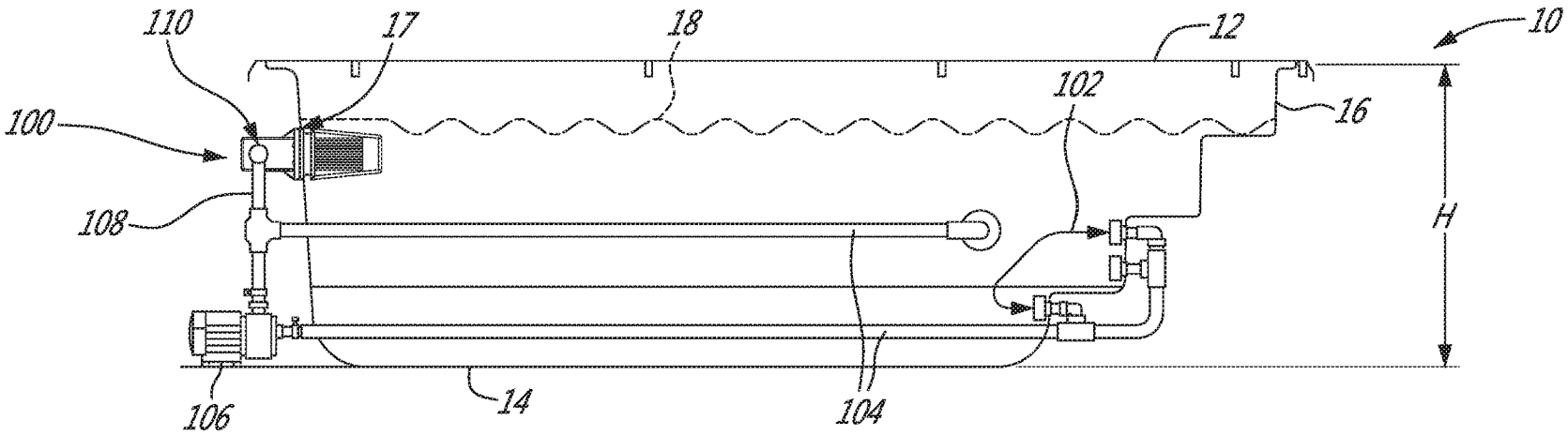
FIG. 1 is a cross-sectional view of a swim-in-place spa in accordance with an embodiment of the present disclosure.

Referring to FIG. 1, a swim-in-place spa 10 is illustrated. The spa 10 comprises a basin 12 configured for containing water. In the embodiment shown, the basin 12 is molded from a single piece of material. In an alternate embodiment, the basin 12 has a plurality of interconnected panels. In the embodiment shown, the basin 12 has a bottom wall portion 14 and lateral wall portions 16. The lateral wall portions 16 are disposed substantially perpendicular relative to a water surface 18.

The spa 10 further has a circulation subsystem 100 affixed adjacent to the lateral wall portions 16 of the basin 12. The circulation subsystem 100 comprises an inlet provided in the form of an aperture 102 defined through the lateral wall portions 16, a conduit 104, a pump 106 affixed to the basin 12, another conduit 108, and a swim-in-place jet assembly 110 disposed through a hole 17 in the basin 12. The conduit 104 fluidly connects the inlet 102 to the pump 106. The conduit 108 fluidly connects the pump 106 to the swim-in-place jet assembly 110. In operation, the pump 106 draws water out of the basin through the inlet 102 and routes the extracted water toward the swim-in-place jet assembly 110 for being injected back in the basin 12. A more detailed description of the swim-in-place jet assembly 110 and of its operation is presented below. In a particular embodiment, a height H of the swim-in-place spa 10 is from 49 to 53 inches, a width W is about 93 inches and a length L is from 12 to 20 feet.

In an alternate embodiment, the conduits 104 and 108 may be substituted by a passage defined within a thickness of the bottom wall portion 14 and/or the lateral wall portions 16 of the basin 12. Also, the inlet 102 may be disposed through the bottom wall portion 14. In a particular embodiment, the conduits 104 and 108 have a diameter of 2.5 inches.

Figure 2:
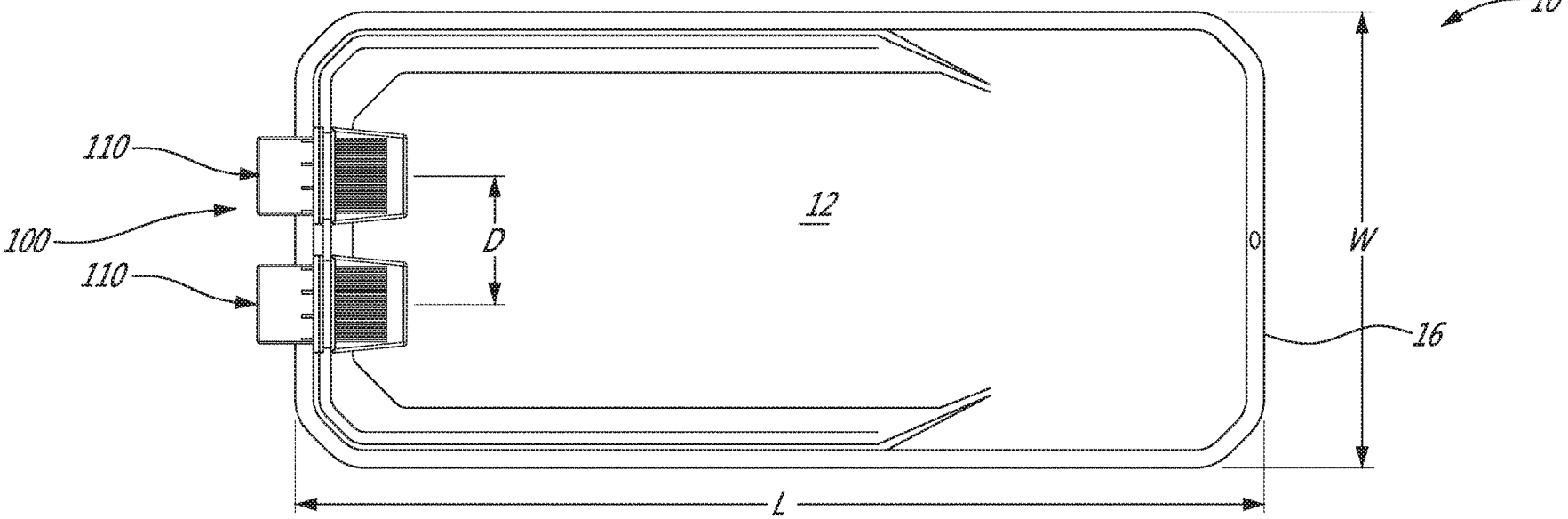
FIG. 2 is a schematic top view of the swim-in-place spa of FIG. 1.

Referring to FIG. 2, in an alternate embodiment, more than one swim-in-place jets 110 laterally spaced from one another relative to the width W of the basin 12 are used. Each of the swim-in-place jets assemblies 110 are fluidly connected to a respective pump (not shown). Alternatively, only one pump is used to supply water to all the swim-in-place jet assemblies 110. In the illustrated embodiment, two swim-in-place jets 110 are used and spaced apart by a distance D. In a particular embodiment, D corresponds to from 12 to 18 inches. In such a particular embodiment, a width of each of the jets is from 6 to 10 inches. In a particular embodiment, each jet has a width of 9.75 inches.

In a particular embodiment, independent pumps and circuits are provided to supply water to each of the jets. Each pump 106 is configured for discharging a maximum flow rate of approximately 25 liters per second (400 US GPM) from a motor of about 4.7 horse power (3500 watts). The pump is selected to maximize the volumetric flow rate as the pressure loss is relatively low, typically from 12 to 20 PSI. The pump needs mainly to overcome the thrust generated by the swimmer and pressure losses in the system 100. In an alternate embodiment, the maximum flow rate varies depending on some parameters, such as, but not limited to, the exact configuration of the basin, the number of jets, and user preferences, for instance.

Figure 3:
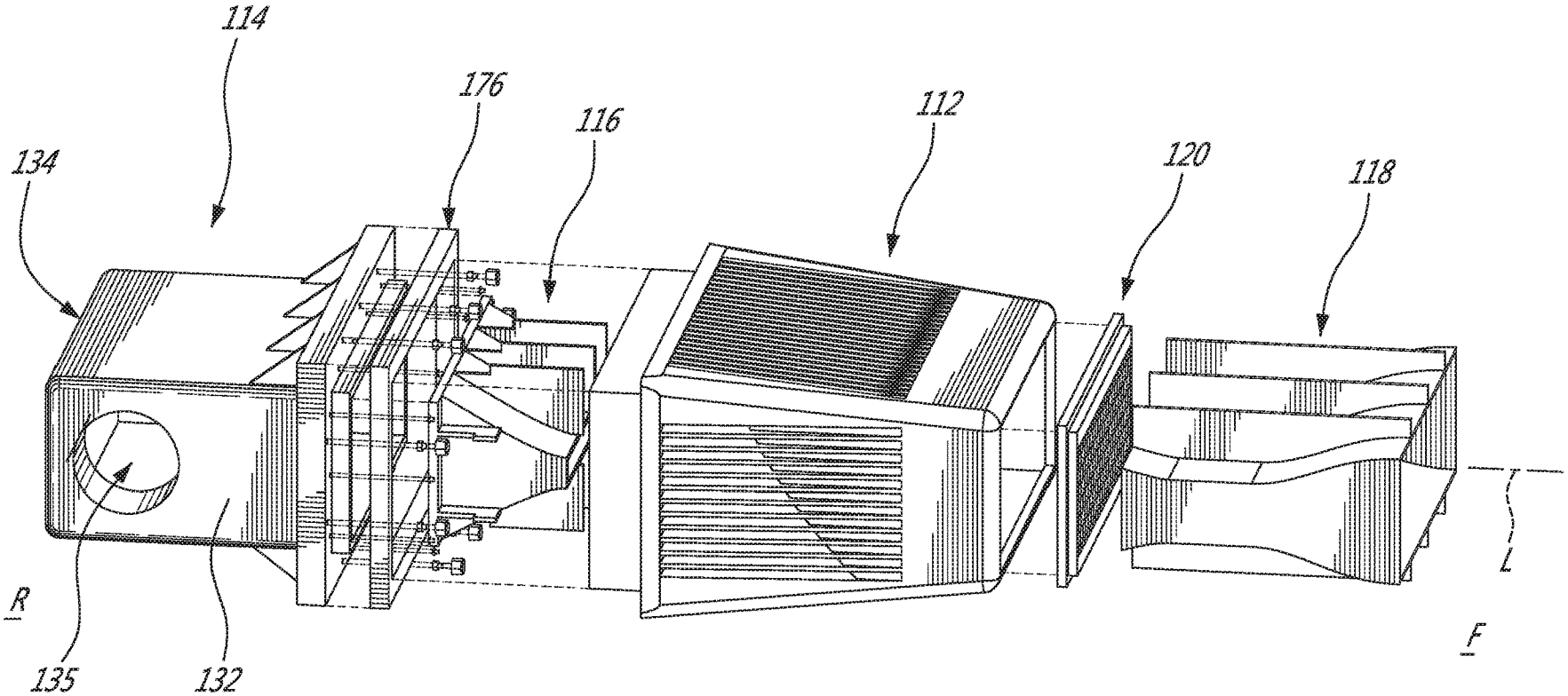
FIG. 3 is an oblique exploded view of the swim-in-place jet of FIG. 1.

Referring to FIG. 3, the swim-in-place jet assembly 110 comprises an enclosure 112, an input chamber 114, a nozzle 116, a diffuser 118, and a flow straightener 120. The input chamber 114, the nozzle 116, the diffuser 118, and the flow straightener 120 are serially disposed along a longitudinal axis L. The enclosure 112 surrounds the nozzle 116, the diffuser 118, and the flow straightener 120.

Figure 4:
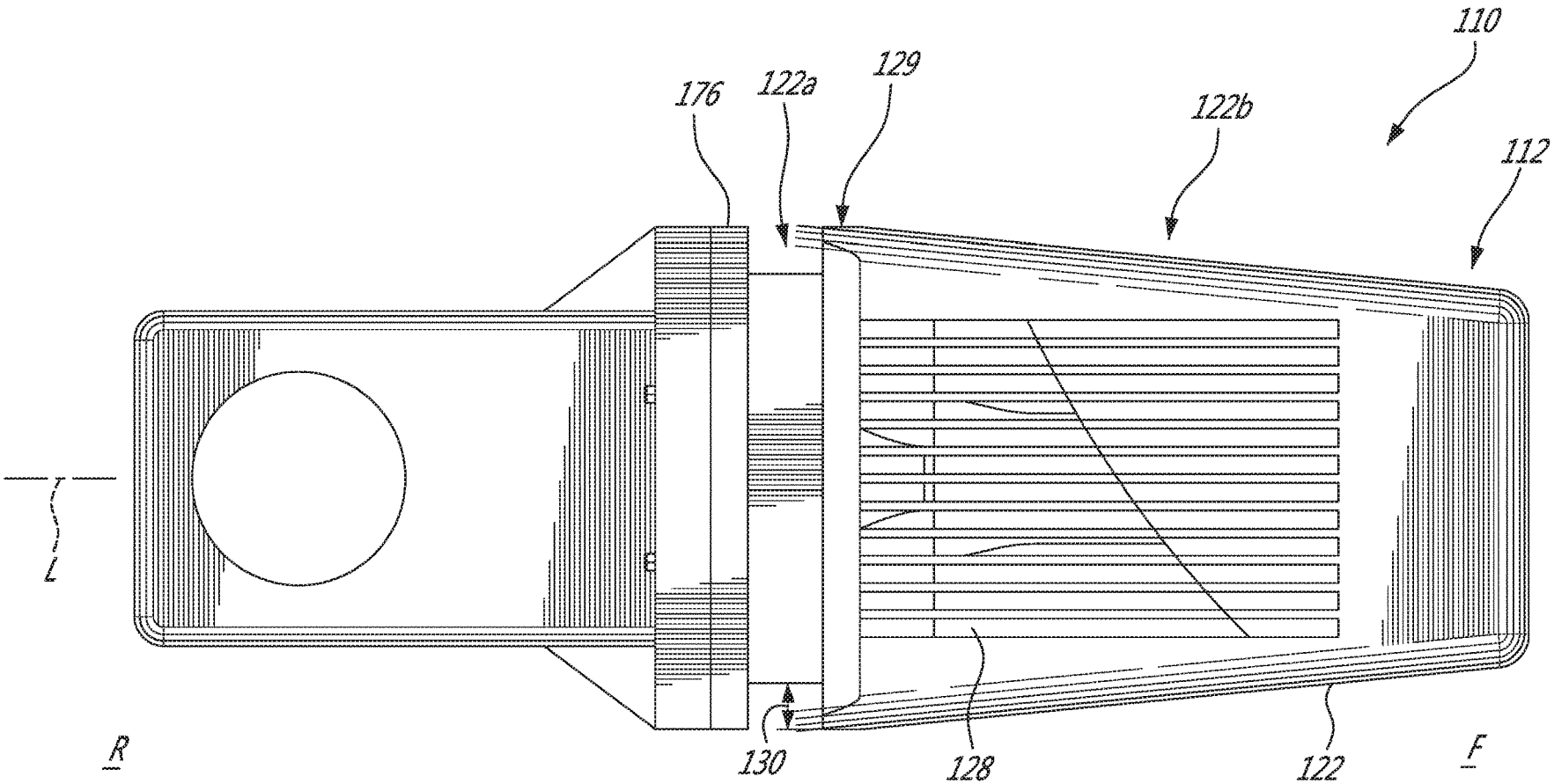
FIG. 4 is a side elevation view of the swim-in-place jet of FIG. 3.
Figure 5:
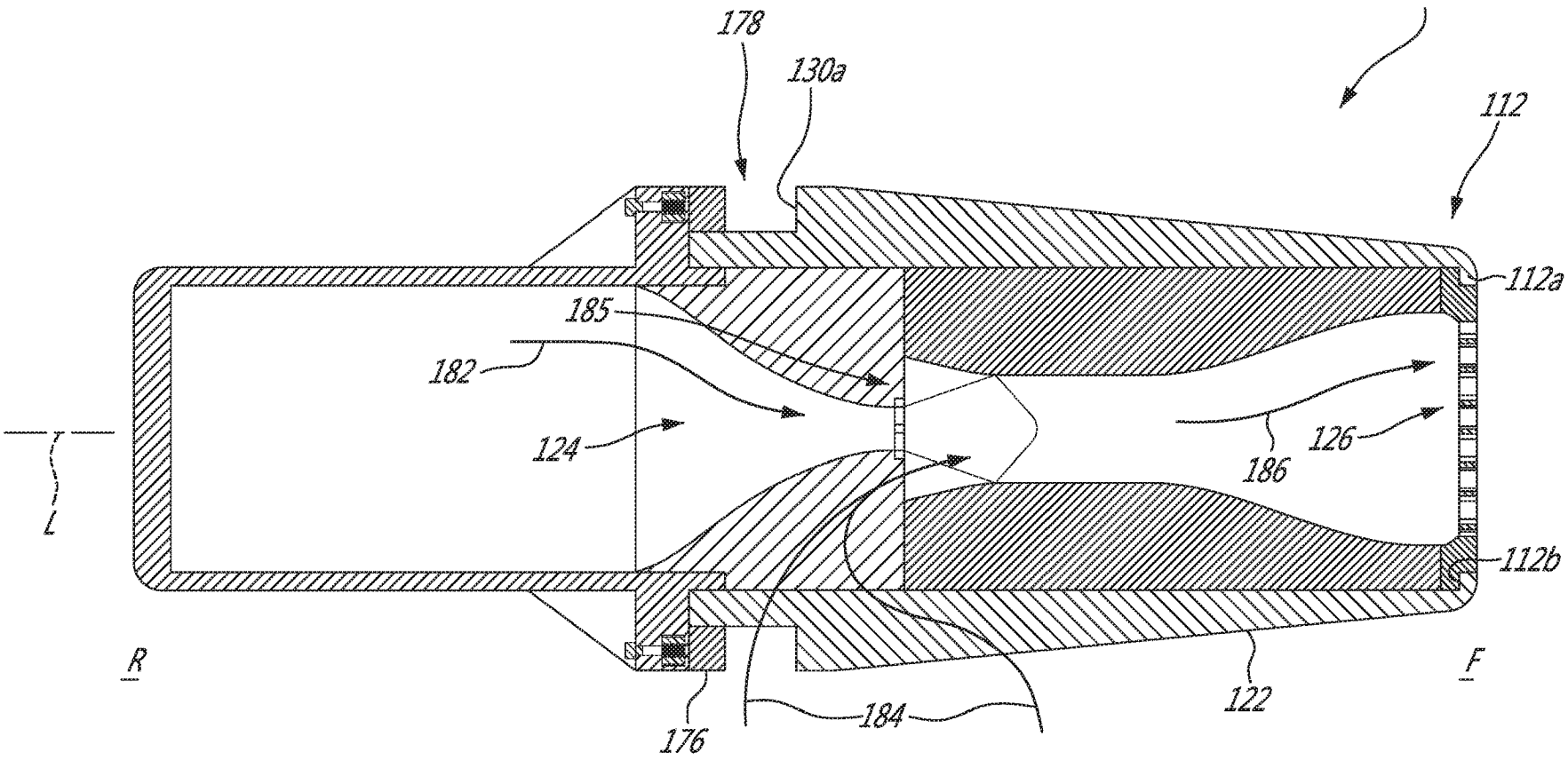
FIG. 5 is a cross-sectional view of the swim-in-place jet of FIG. 3.

Referring to FIGS. 4-5, the enclosure 112 has a wall 122 extending around the longitudinal axis L. The enclosure 112 has an inlet 124, an outlet 126 axially spaced-apart from the inlet 124 relative to the longitudinal axis L, and apertures 128 defined through the wall 122. In the embodiment shown, all sides of the enclosure 112 define apertures 128. It is contemplated to have apertures 128 only to particular faces of the enclosure 112. The apertures 128 are provided in the form of longitudinally extending slots. In a particular embodiment, the length of the slots relative to the longitudinal axis L increases toward a bottom of the swim-in-place spa 10.

The enclosure 112 has an annular flange **112*a* surrounding the outlet 126 and protruding inwardly from the wall 122 toward the longitudinal axis L. The annular flange 112*a* defines an abutting surface 112*b* perpendicular to the longitudinal axis L and facing toward a rear end R of the assembly 110**.

The wall 122 has a recessed portion **122*a* and a sloped portion 122*b*. The recessed portion 122*a* extends along the longitudinal axis L from the inlet 124 toward an intersection 129 between the recessed and sloped portions. The intersection 129 creates a gap 130 between the thicknesses of the recessed and sloped portions. The gap 130 defines an abutting surface 130*a* perpendicular to the longitudinal axis L and facing toward the rear end R. In a particular embodiment, a thickness of the wall 122 decreases along the longitudinal axis L from the intersection 129 toward the outlet 126 of the enclosure 112. In the illustrated embodiment, the apertures 128 are defined through the sloped portion 122*b* of the wall 122**.

Figure 6:
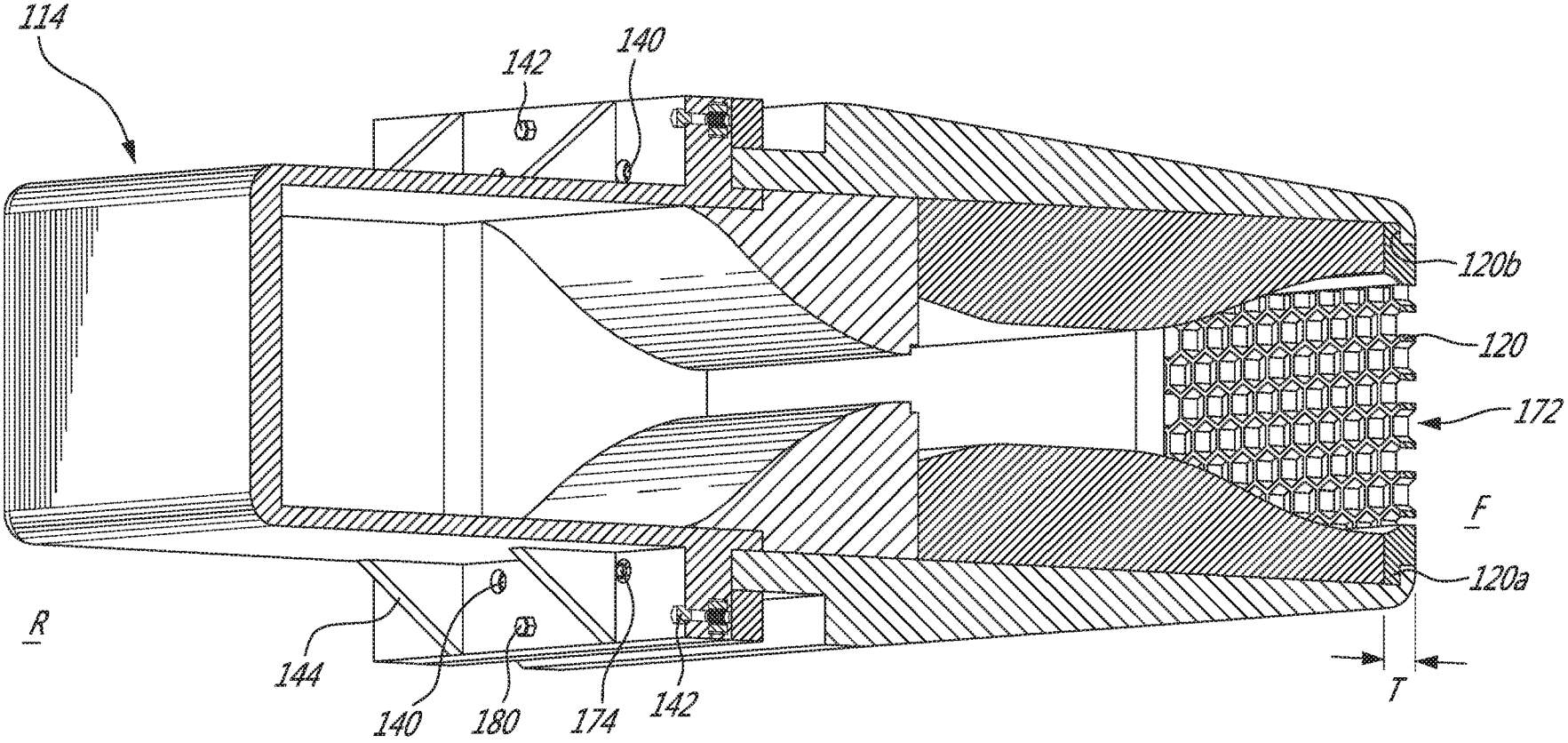
FIG. 6 is an oblique cross-sectional view of the swim-in-place jet of FIG. 3.
Figure 7:
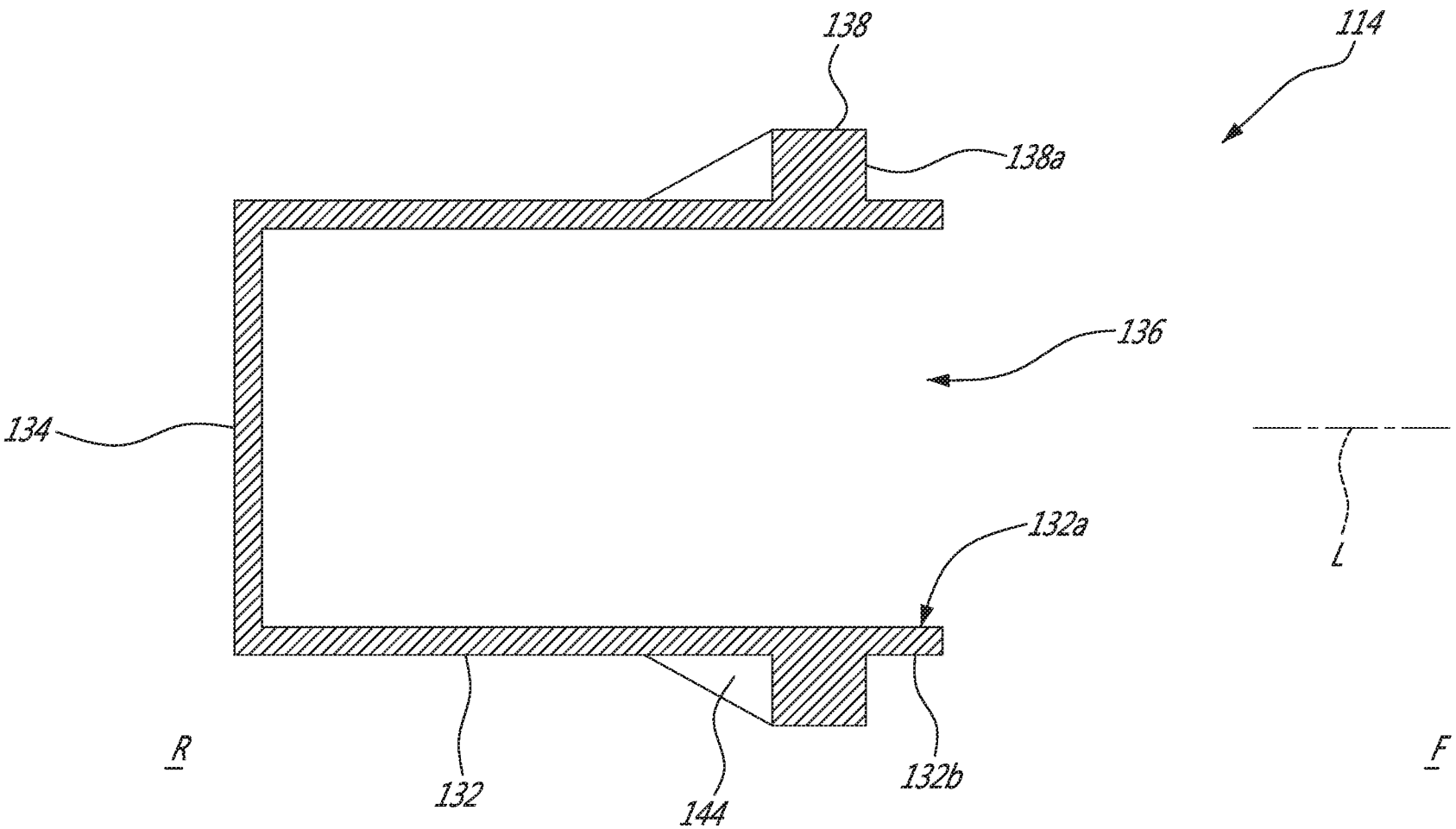
FIG. 7 is a cross-sectional view of the input chamber of the swim-in-place jet of FIG. 3.

Now referring to FIGS. 6 and 7, the input chamber 114 has a lateral wall 132 extending around the longitudinal axis L and a rear wall 134 perpendicular to the axis L, connected to the lateral wall 132, and located at the rear end R of the assembly 110. In the embodiment shown, the input chamber 114 has an inlet provided in the form of an aperture 135 defined through the lateral wall 132 for receiving water from the pump 106 through the conduit 108 and an outlet 136 fluidly connected to the nozzle 116 which is described herein below.

The input chamber 114 further has a flange 138 extending outwardly from the lateral wall 132, away from the longitudinal axis L, and surrounding the longitudinal axis L. The flange 138 defines an abutting surface 138*a* facing toward a front end F of the assembly 110. The flange 138 also comprises a first series of apertures 140 and a second series of apertures 142 radially offset from the first series of apertures 140. In a particular embodiment, fins 144 are connected to the flange 138 and to the lateral wall 132 for structural integrity.

A portion 132*a* of the input chamber lateral wall 132 protrudes axially away from the flange 138 toward the front end F of the assembly 110. The portion 132*a* thereby defines an abutting surface 132*b* facing outwardly away from the longitudinal axis L.

Figure 8:
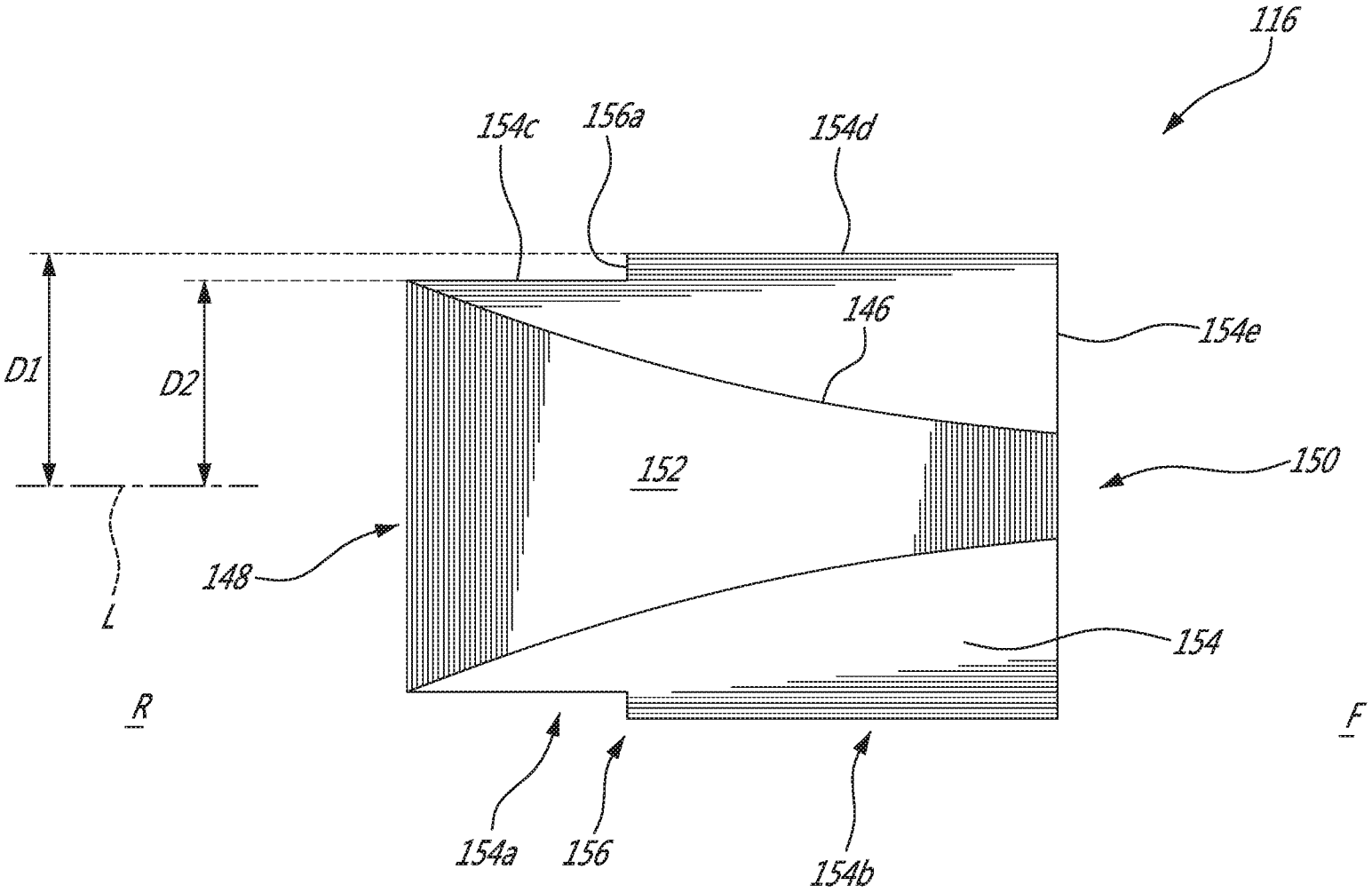
FIG. 8 is a cross-sectional view of the nozzle of the swim-in-place jet of FIG. 3.

Referring to FIG. 8, the nozzle 116 has a wall 146 extending around the axis L. The nozzle 116 has an inlet 148 and an outlet 150 axially spaced apart from the inlet 148 relative to the longitudinal axis L. The nozzle 116 defines a flow passage 152 delimited by the wall 146. In a particular embodiment, a cross-sectional area of the flow passage 152 decreases along the longitudinal axis L between the inlet 148 and the outlet 150.

The nozzle 116 has a plurality of fins 154 extending outwardly from the wall 146 and away from the longitudinal axis L. Each one of the fins 154 has a first section 154*a* and a second section 154*b* axially offset from the first section 154*a* relative to the longitudinal axis L. A thickness of the first and second sections of the fins 154 defines abutting surfaces, 154*c* and 154*d*, facing outwardly away from the longitudinal axis L. A distance D1 between the abutting surface 154*d* and the longitudinal axis L is greater than a distance D2 between the abutting surface 154*c* and the longitudinal axis L. An intersection 156 between the sections 154*a* and 154*b* defines an abutting surface 156*a* facing toward the rear end R of the assembly 110. The second section 154*b* also defines an abutting surface 154*e* facing toward the front end F of the assembly 110.

Figure 9:
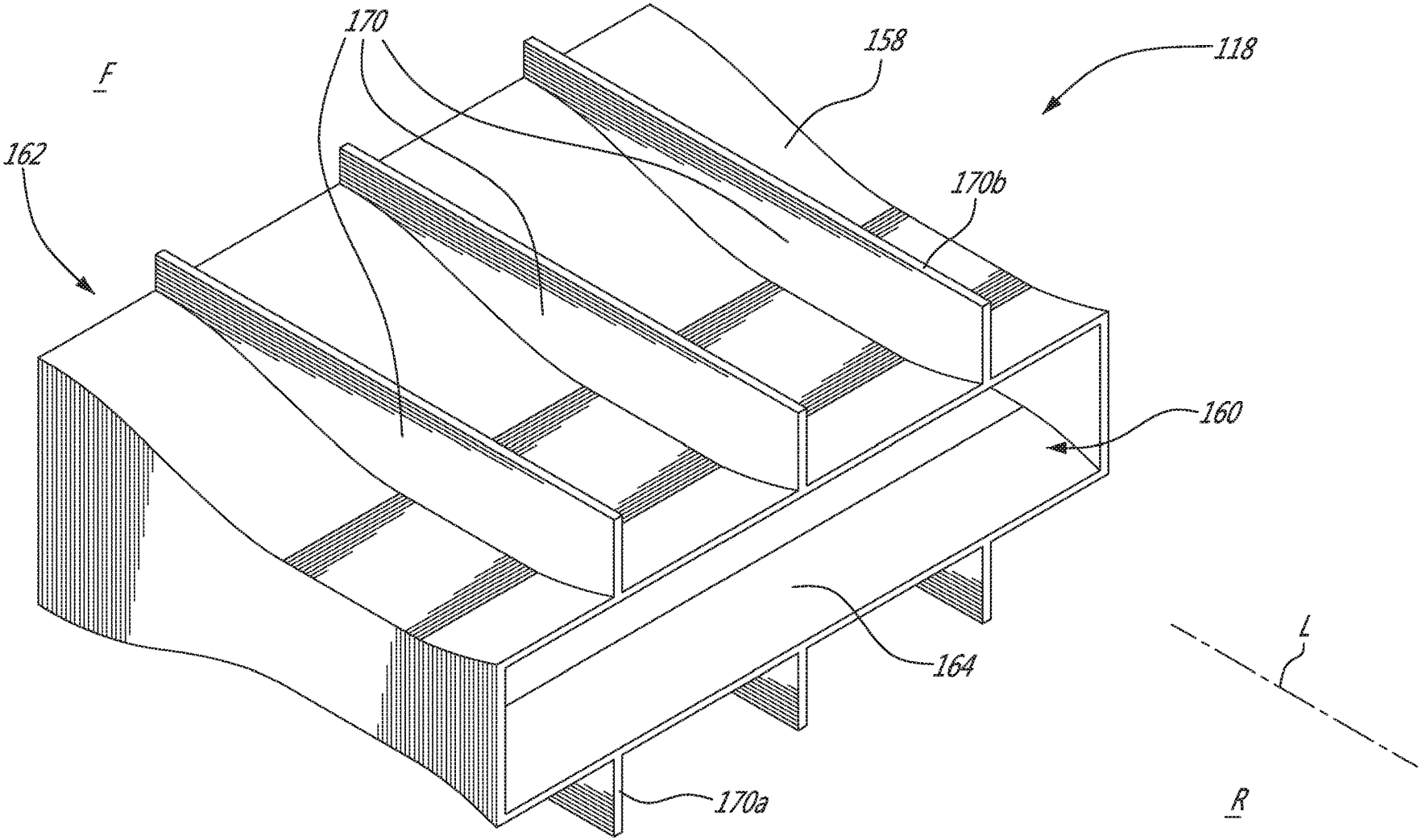
FIG. 9 is an oblique view of the diffuser of the swim-in-place jet of FIG. 3.
Figure 10:
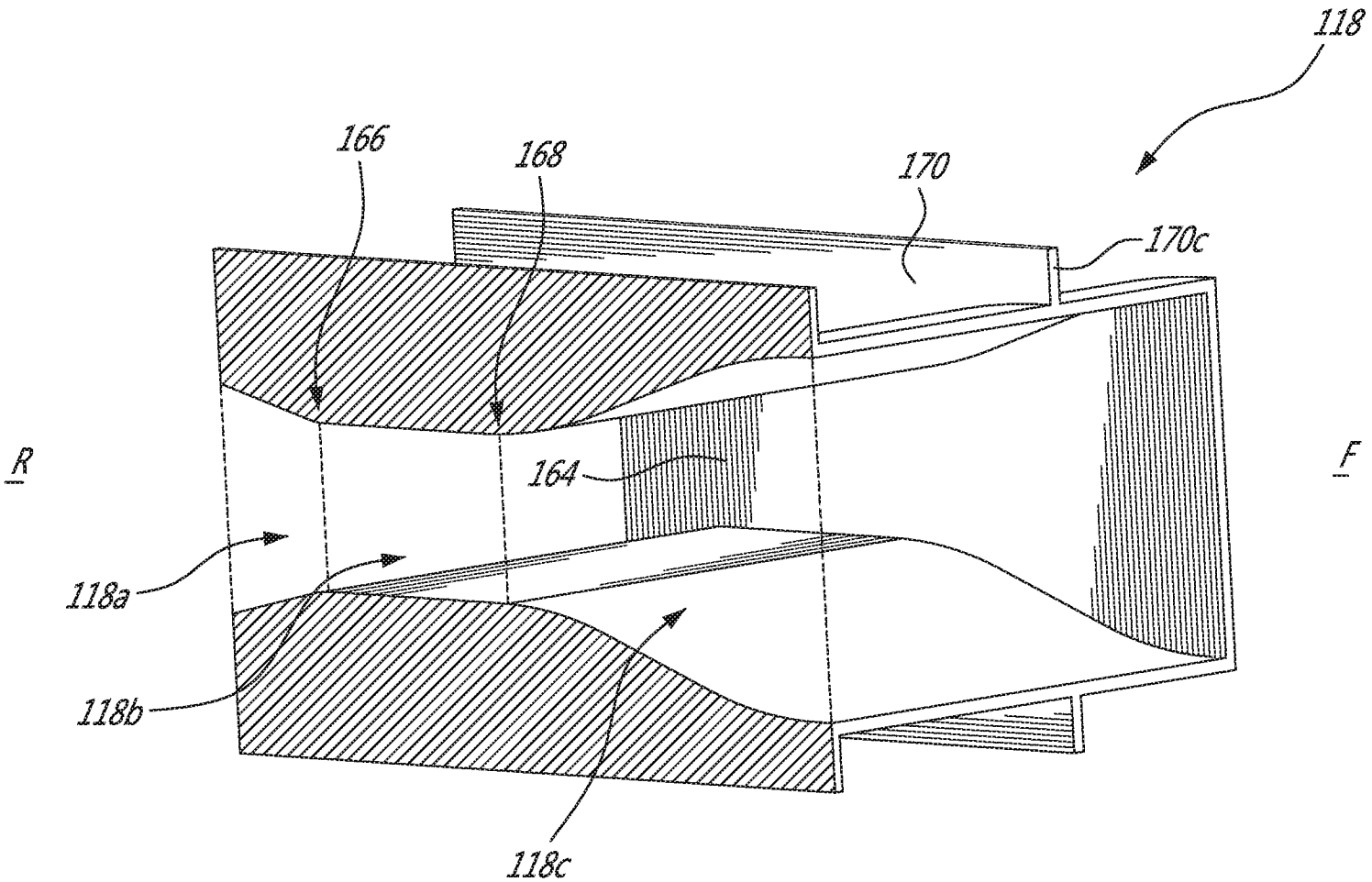
FIG. 10 is an oblique cross-sectional view of the diffuser of the swim-in-place jet of FIG. 3.

Now referring to FIGS. 9-10, the diffuser 118 has a wall 158 extending around the longitudinal axis L. The diffuser 118 has an inlet 160 and an outlet 162 axially spaced apart from the inlet 160 relative to the longitudinal axis L. The diffuser 118 defines a flow passage 164 delimited by the wall 158. The diffuser 118 has three sections, a converging section 118*a*, a mixing section 118*b*, and a diverging section 118*c*. The three sections 118*a*, 118*b*, and 118*c* are disposed serially along the longitudinal axis L. A cross-sectional area of the flow passage 164 decreases in the converging section 118*a*, remains constant in the mixing section 118*b*, and increases in the diverging section 118*c*. In the illustrated embodiment, an intersection 166 between the converging section 118*a* and the mixing section 118*b*, and an intersection 168 between the mixing section 118*b* and the diverging section 118*c* are continuously gradual such that the intersections 166 and 168 are free of sharp edges. In a particular embodiment, the intersections 166 and 168 have parabolic shapes.

Similarly to the nozzle 116, the diffuser 118 has a plurality of fins 170 extending outwardly from the wall 158 away from the longitudinal axis L. Each one of the fins 170 defines three abutting surfaces, 170*a*, 170*b*, and 170*c*. The surface 170*a* faces toward the rear end R of the assembly while the surface 170*c* faces toward the front end F of the assembly 110. The surface 170*b* faces outwardly away from the longitudinal axis L.

Referring back to FIG. 6, the swim-in-place jet assembly 110 further comprises the flow straightener 120 disposed within the enclosure 112, between the diffuser 118 and the enclosure outlet 126, and perpendicular to the longitudinal axis L. The flow straightener 120 is a plate of a thickness T defining a plurality of apertures 172. In the embodiment shown, each of the apertures 172 has an hexagonal shape. The apertures 172 may have any suitable shape. The flow straightener 120 has an annular flange 120*a* defining an abutting surface 120*b* facing toward the front end F of the assembly 110.

Referring now to FIGS. 1-10, the swim-in-place jet assembly 110 is assembled as follows. First, the flow straightener 120 is inserted inside the enclosure 112 until the abutting surface 120*b* of the annular flange 120*a* abuts against the abutting surface 112*b* of the enclosure annular flange 112*a*. Then, the diffuser 118 is inserted until the abutting surfaces 170*c* of the diffuser fins 170 abut against the flow straightener 120. In the illustrated embodiment, the abutting surfaces 170*b* of the diffuser fins 170 abut against the enclosure wall 122. Then, the nozzle 116 is inserted inside the enclosure until the abutting surfaces 154*e* of the nozzle fins 154 abut against the abutting surfaces 170*a* of the diffuser fins 170. In the embodiment shown, the abutting surfaces 154*d* of the nozzle fins 154 abut against the enclosure wall 122. The next step is to insert the input chamber 114 such that the portion 132*a* of the input chamber lateral wall 132 is disposed between the abutting surface 154*c* of the nozzle fins 170 and the recessed portion 122*a* of the enclosure wall 122. Once inserted, the abutting surface 138*a* of the input chamber flange 138 abuts against an annular surface defined by a thickness of the enclosure wall 122. By so inserting the input chamber 114 between the nozzle fins 154 and the enclosure wall 122, movements of the input chamber 114 relative to the enclosure 112 are limited.

In a particular embodiment, the enclosure 112, containing the nozzle 116, the diffuser 118, and the flow straightener 120, is inserted through the hole 17 defined through the basin 12 from the interior of the basin 12 until the abutting surface 130*a* of the enclosure wall 122 abuts against the basin lateral wall 16. Then, the input chamber 114 is inserted as described above from the outside of the basin 12. The assembly 110 is fixed with fasteners 174 inserted in the first series of apertures 140 defined through the input chamber flange 138. The fasteners 174 then penetrates the enclosure wall 122 in a direction parallel to the longitudinal axis L. Accordingly, the basin lateral wall 16 is sandwiched between the flange abutting surface 138*a* and the abutting surface 130*a*.

In the illustrated embodiment, the assembly 110 further comprises an annular flange 176 disposed between the basin lateral wall 16 and the flange 138 to adjust the length of a groove 178 to a thickness of the basin lateral wall 16. Fasteners 180, inserted through the second series of apertures 142, are used to fix the annular flange 176 to the flange 138.

Referring more particularly to FIG. 5, in operation a primary water flow 182 is routed to the input chamber 114 that is fluidly connected to the nozzle 16. The outlet 136 of the input chamber 114 has an cross-sectional area greater than its inlet 135. Hence, the primary water flow 182 decreases in velocity which reduces the Reynolds number. The input chamber outlet 136 and the nozzle inlet 148 have matching shapes and cross-sectional areas.

Then, the velocity of the primary water flow 182 increases because the cross-sectional area of the nozzle 116 decreases along the longitudinal axis L between the nozzle inlet 148 and the nozzle outlet 150. The primary water flow 182 then exits the nozzle 116 and enters the diffuser 118. Because of a pressure difference between the primary water flow 182 and the surrounding water, the primary water flow 182 exiting the nozzle 116 entrains a secondary water flow 184 through the apertures 128 of the enclosure 112 and inside the diffuser 118 whose inlet 160 is greater than the nozzle outlet 150 thereby defining a gap 185. The mass flow rate through the diffuser 118 is therefore greater than the mass flow rate through the nozzle 116. The entrainment phenomenon is also known as the Venturi effect.

Both the primary 182 and secondary 184 water flows then enter the converging section 118*a* in which they are accelerated due to the decreasing cross-sectional area. Water then enters the mixing section 118*b* in which turbulence contributes to mix the primary flow 182 and the secondary flow 184 to yield a mixed water flow 186. The mixed water flow 186 is then decelerated in the diverging section 118*c* of the diffuser to reduce speed and turbulence. The flow 186 passes through the straightener 120 to further reduce turbulence before being expulsed in the basin 12 toward a swimmer.

In a particular embodiment, the volumetric flow rate of water provided from the pump 106 to the input chamber 114 is 340 U.S. gallons per minutes (gpm). Hence, the primary water flow 182 of 340 gpm exits the nozzle 116 and is injected in the diffuser 118. The Venturi effect described herein above increases the total flow rate to 700 gpm. The difference of 360 gpm corresponds to the flow rate of the secondary water flow 184. Once water exits the swim-in-place jet assembly 110, it entrains the surrounding water toward the swimmer increasing as such the flow rate to approximately 1400 gpm. In alternate embodiments, and depending on the exact conditions of operation, these ratios can vary.

Figure 11:
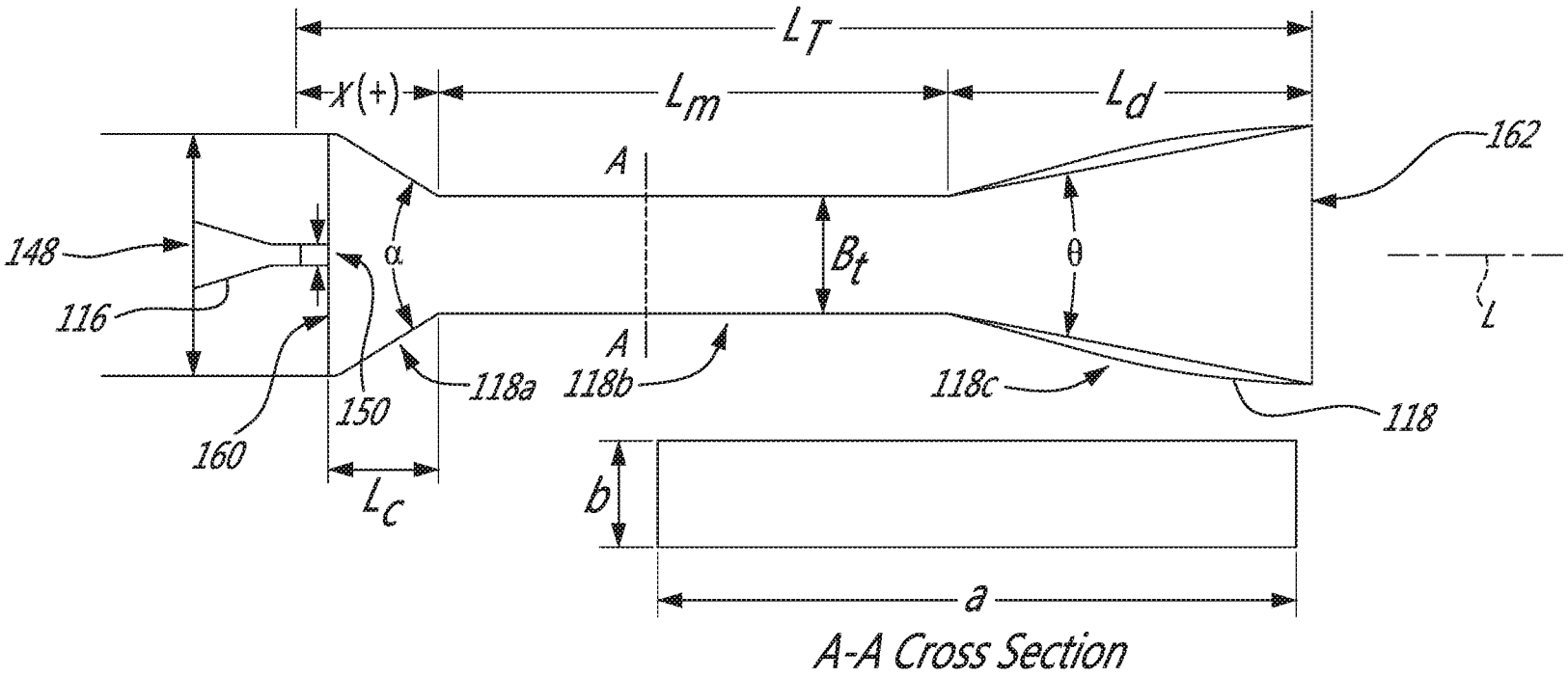
FIG. 11 is a schematic cross-sectional view of the swim-in-place jet of FIG. 3.

Referring now to FIG. 11, in a particular embodiment, the nozzle 116 and the diffuser 118 have a cross-section characterized by a width parallel to the water surface greater than a height perpendicular to the water surface. In a particular embodiment, at least the cross-section of the diffuser outlet 162 of the swim-in-place jet assembly 110 has a rectangular shape. In the illustrated embodiment, all components have rectangular shapes. It is contemplated to use other shapes, such as, but not limited to ellipsoid. In a particular embodiment, a ratio of a width over a height of the diffuser outlet 162 is greater than or equal to 2. In a particular embodiment, the ratio is 3.08 or greater. In a particular embodiment, the width of the diffuser outlet 162 is 9.75 inches and the height is 2.055 inches yielding a ratio of 4.7 inches.

In a particular embodiment, the width of the nozzle inlet 148 is 9.5 inches and the height is 4 inches. The width of the nozzle outlet 150 is 8 inches and the height 0.5 inch. In a particular embodiment, a ratio of a width over a height of the nozzle inlet 148 is equal to or greater than 2. In the embodiment shown, the ratio is 2.375. In the illustrated embodiment, a ratio of a width over a height of the nozzle outlet 150 is 16. In a particular embodiment, the ratio is greater than 16.

The width of the diffuser inlet 160 is 9.75 inches and the height is from 1 to 2 inches. The width of the diffuser outlet 162 is 9.25 inches and the height is 3 inches. The lengths $L_c$, $L_m$, $L_d$ of the converging 118*a*, mixing 118*b*, and diverging 118*c* sections of the diffuser 118 are from 1.8 inches to 3.5 inches, from 9 inches to 17 inches, and from 3.5 inches to 7 inches, respectively. In a particular embodiment, a length of the mixing section 118*b* along the axis L corresponds to at least 60% of a total length of the diffuser 118. Because of its longer length, the mixing section 118*c* is more efficient at mixing the primary 182 and secondary 184 water flows. However, the length $L_m$ of the mixing section 118*c* is limited by the length of the swim-in-place pool. If the mixing section 118*c* is made longer, the swimming space for the swimmer is reduced. Hence, the length $L_m$ has to be carefully optimized. In a particular embodiment, a ratio of a width over a height of the diffuser inlet 160 is from 4 to 10. In a particular embodiment, the ratio is from 4.875 to 9.75.

In a particular embodiment, a distance x(+) along the longitudinal axis L between the nozzle outlet 150 and the beginning of the mixing section 118*b* is from 0.45 to 1.15 times the height of the mixing section. In a particular embodiment, the height of the mixing section 118*b* is from 0.19 inch to 0.55 inch. In a particular embodiment, the opening angle $\alpha$ of the converging section 118*a* is from 20 degrees to 45 degrees, preferably about 25 degrees, and the opening angle $\theta$ of the diverging section 118*c* is from 8 to 25 degrees, preferably 8 to 20 degrees. In a particular embodiment, the angle $\theta$ is less than 20 degrees and the angle $\alpha$ is more than 20 degrees.

In a particular embodiment, a ratio of the total length of the diffuser 118 along the longitudinal axis L over a height of the diffuser inlet 160 is from 13 to 15. In a particular embodiment, the ratio is from 13.28 to 14.51. In a particular embodiment, the total length of the diffuser 118 is 7.5 inches, the height of the mixing section 118*b* is 1.5 inches yielding a ratio of the diffuser length over the mixing section height of 5. In a particular embodiment, the ratio of the diffuser length over the mixing section height is from 3 to 6. It is understood that it is possible to tune such ratios depending on the type of fluid used.

The swim-in-place jet 110 is configured such that the water jet that it generates diffuse in the water and, once it reaches the swimmer, it has a shape of approximately 30 inches in width by 12 inches in height. Such dimensions approximately match a cross-section of the swimmer who therefore swims in a flow of substantially uniform velocity. In a particular embodiment, the jet, in the swim-in-place spa, has a Reynolds number from 280000 to 350000.

Figure 12:
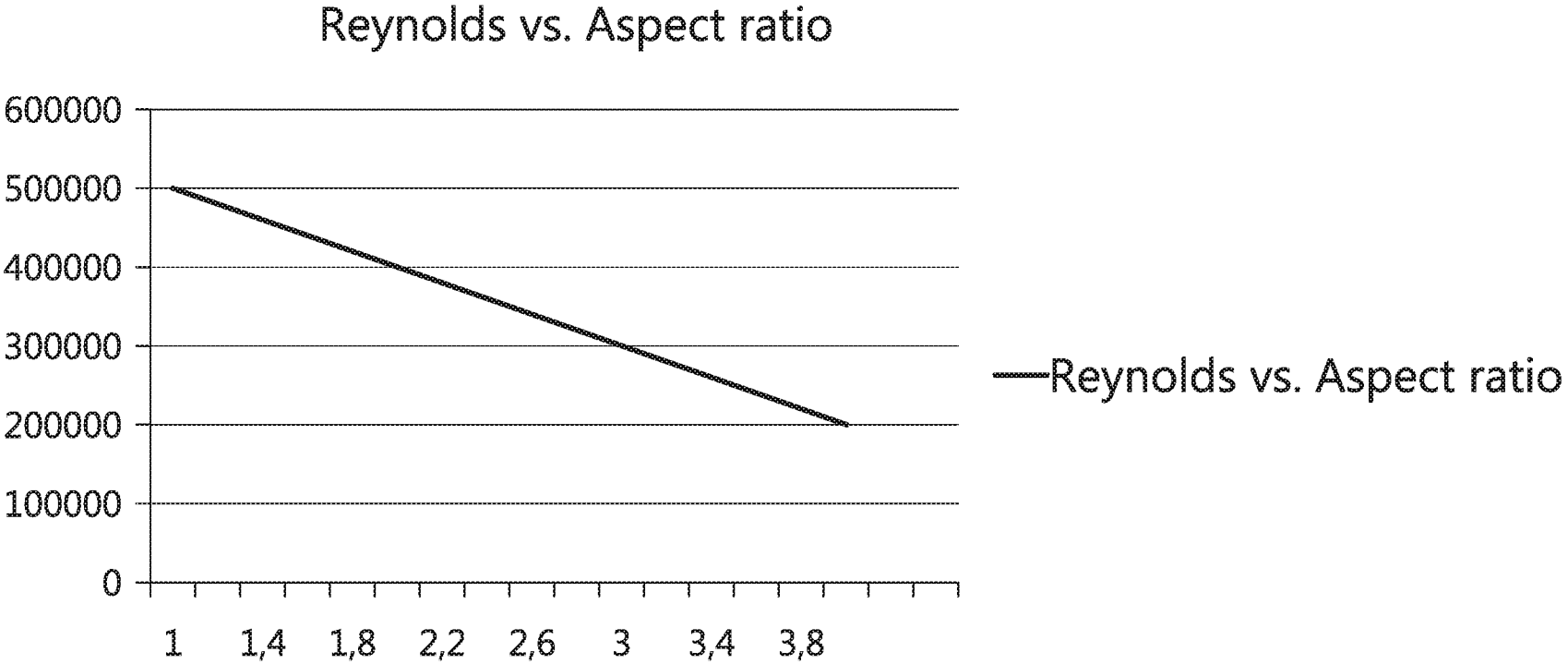
FIG. 12 is graph illustrating a relation between the aspect ratio of the nozzle outlet and the Reynolds number.

Now referring to FIG. 12, the aspect ratio is defined as the ratio of the width of the nozzle outlet 162 over the height of the nozzle outlet 162. The graph illustrates that the Reynolds number decreases by increasing the aspect ratio while keeping the other parameters constant. Accordingly, further increasing the aspect ratio would offer better performances. But, the aspect ratio is limited by other factors such as the width of the spa 12.

Although it has been observed that increasing the ratio of the width over the height decreases the Reynolds number, it should be limited below a given threshold beyond which the jet would not be adapted to match the shape of the swimmer. In a particular embodiment, a matrix of swim-in-place jets is used, such as two jets along the width of the spa and two jets along the height of the spa, in a manner to reduce the height of each individual jet while still covering a height corresponding to the height of the swimmer. In such a case, each jet may have a width of 10 inches and a height of 2 inches. It is understood that more or less jets may be used without departing from the scope of the present disclosure. It can be preferred to maintain a Reynolds number of less than 350000 at the jet output.

It is understood that the assembly 110 may be used with other fluids and with other applications than a swim-in-place spa without departing from the scope of the present disclosure.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A swim-in-place spa, comprising:

a basin for containing water, a circulation subsystem having:

a primary conduit extending from an inlet in the basin;

at least one pump fluidly connected to the primary conduit to pump water from the inlet;

at least one swim-in-place jet affixed to the basin; and a secondary conduit extending from the pump to the swim-in-place jet, in operation the pump inducing a flow of water toward the swim-in-place jet, the at least one swim-in-place jet having:

a nozzle having a nozzle inlet and a nozzle outlet, a diffuser downstream of the nozzle relative to the flow of water, the nozzle outlet smaller than a diffuser inlet, the nozzle outlet and the diffuser inlet disposed in a radially spaced-apart relationship defining a gap for receiving a flow of entrained water, an enclosure having a wall extending around a longitudinal axis, apertures defined through the wall, the apertures in fluid flow communicating with the gap for receiving the flow of entrained water through the wall, the diffuser located within the enclosure, and at least one flow passage defined radially between the enclosure and the diffuser relative to the longitudinal axis, the at least one flow passage having a passage inlet defined by the apertures through the wall of the enclosure, the at least one flow passage having a passage outlet defined by the gap, the flow of entrained water flowing from the passage inlet to the passage outlet along the diffuser in a direction opposite a flow direction of the water from the nozzle inlet to a diffuser outlet of the diffuser, the circulation subsystem configured for creating a water jet, and an input chamber fluidly connected to and upstream of the enclosure, the input chamber having a wall extending around the longitudinal axis and a flange extending radially-outward from the wall of the input chamber, the flange abutting against an annular surface defined by a thickness of the wall of the enclosure.

2. The swim-in-place spa according to claim 1, the at least one swim-in-place jet comprising two swim-in-place jets affixed to the basin and spaced-apart relative to a width of the swim-in-place spa.

3. The swim-in-place spa according to claim 2, the at least one pump comprising two pumps, each of the two pumps fluidly connected to a respective one of the two swim-in-place jets.

4. The swim-in-place spa according to claim 1, wherein a ratio of a nozzle inlet area over a nozzle outlet area is 9.5.

5. The swim-in-place spa according to claim 1, wherein a ratio of a width over a height of the nozzle inlet is greater than 2 and wherein a ratio of a width over a height of the nozzle outlet is equal to or greater than 16.

6. The swim-in-place spa according to claim 1, wherein a ratio of a width over a height of the diffuser inlet is from 4 to 10.

7. The swim-in-place spa according to claim 1, wherein the diffuser further has a mixing section upstream of a diffusing section, a ratio of a distance along a primary flow between the nozzle outlet and an inlet of the mixing section over a height of the mixing section is from 0.45 to 1.15.

8. The swim-in-place spa of claim 1, wherein the diffuser has a converging section downstream of the diffuser inlet, a diverging section upstream of the diffuser outlet of the diffuser, and a mixing section between the converging and diverging sections, a cross-sectional area of the diffuser decreasing in the converging section and increasing in the diverging section, the diffuser outlet being greater than the diffuser inlet, a transition between the mixing and diverging sections being continuously gradual.

9. The swim-in-place spa according to claim 8, wherein a ratio of a width over a height of the diffuser outlet is greater than 3.

10. The swim-in-place spa according to claim 8, wherein a ratio of a length of the diffuser over a height of the diffuser inlet is from 13 to 15.

11. The swim-in-place spa according to claim 8, wherein the converging section has an opening angle of 25 degrees and wherein the diverging section has an opening angle of from 8 to 25 degrees.

12. The swim-in-place spa according to claim 8, wherein an intersection between the mixing section and the diverging section has a parabolic shape.

13. The swim-in-place spa according to claim 8, wherein a length of the mixing section corresponds to at least 60% of a total length of the diffuser, the mixing section having a constant cross-section.

14. The swim-in-place spa according to claim 1, wherein the nozzle is located within the enclosure, the nozzle inlet proximate an enclosure inlet, the diffuser inlet axially offset relative to the nozzle inlet and the diffuser outlet proximate an enclosure outlet.

15. The swim-in-place spa according to claim 1, wherein the water jet created with one of the swim-in-place jets is 30 inches in width by 12 inches in height.

16. The swim-in-place spa according to claim 1, wherein the nozzle outlet is longitudinally aligned with the diffuser inlet.

17. A swim-in-place spa, comprising:

a basin for containing water, a circulation subsystem having:

a primary conduit extending from an inlet in the basin;

at least one pump fluidly connected to the primary conduit to pump water from the inlet;

at least one swim-in-place jet affixed to the basin; and a secondary conduit extending from the pump to the swim-in-place jet, in operation the pump inducing a flow of water toward the swim-in-place jet, the at least one swim-in-place jet having:

a nozzle having a nozzle inlet and a nozzle outlet, a diffuser downstream of the nozzle relative to the flow of water, the nozzle outlet smaller than a diffuser inlet, the nozzle outlet and the diffuser inlet disposed in a radially spaced-apart relationship defining a gap for receiving a flow of entrained water, an enclosure having a wall extending around a longitudinal axis, apertures defined through the wall, the apertures in fluid flow communicating with the gap for receiving the flow of entrained water through the wall, the diffuser located within the enclosure, and at least one flow passage defined radially between the enclosure and the diffuser relative to the longitudinal axis, the at least one flow passage having a passage inlet defined by the apertures through the wall of the enclosure, the at least one flow passage having a passage outlet defined by the gap, the flow of entrained water flowing from the passage inlet to the passage outlet along the diffuser in a direction opposite a flow direction of the water from the nozzle inlet to a diffuser outlet of the diffuser, the circulation subsystem configured for creating a water jet, wherein the at least one flow passage includes a flow passage defined between fins extending from a diffuser wall of the diffuser to the enclosure.

18. The swim-in-place spa according to claim 17, wherein the at least one flow passage includes a plurality of flow passages circumferentially distributed around the longitudinal axis.

19. The swim-in-place spa according to claim 18, wherein the plurality of flow passages include a first group of flow passages defined between the fins extending from upper and lower diffuser walls of the diffuser to the enclosure and a second group of flow passages defined between side walls of the diffuser and the enclosure.

20. The swim-in-place spa according to claim 17, wherein the nozzle and the diffuser have rectangular cross-sections.

* * * * *